US006805059B2

(12) United States Patent
Theurer et al.

(10) Patent No.: US 6,805,059 B2
(45) Date of Patent: Oct. 19, 2004

(54) TAMPING MACHINE

(75) Inventors: Josef Theurer, Vienna (AT); Friedrich Peitl, Linz (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/617,929

(22) Filed: Jul. 11, 2003

(65) Prior Publication Data

US 2004/0031412 A1 Feb. 19, 2004

(30) Foreign Application Priority Data

Jul. 29, 2002 (AT) ..... 507/2002 U

(51) Int. Cl.[7] ..... E01B 27/00

(52) U.S. Cl. ..... 104/12; 104/2

(58) Field of Search ..... 104/12, 701, 10, 104/2

(56) References Cited

U.S. PATENT DOCUMENTS 4,632,037 A 12/1986 Theurer et al.
4,644,868 A * 2/1987 Theurer et al. ..... 104/7.2
5,343,810 A * 9/1994 Theurer ..... 104/12

* cited by examiner

*Primary Examiner*—Mark T. Le
(74) *Attorney, Agent, or Firm*—Henry M. Feiereisen

(57) ABSTRACT

A tamping machine for tamping ballast underneath track ties includes a machine frame extending in a longitudinal direction and supported on the track by two undercarriages. Arranged between the undercarriages is a sub-frame which is supported on the track by a further undercarriage with a unit motive drive and connected to the machine frame by a frame support for displacement relative thereto in the longitudinal direction. A tamping unit and a track lifting unit are arranged on the sub-frame between the further undercarriage and the frame support. Operation of the unit motive drive to displace the sub-frame is assisted by an acceleration drive which is rigidly connected to the machine frame and has a piston end with a bracing plunger provided for temporary application to the sub-frame. A maximum stroke of the acceleration drive is shorter than a maximum displacement path of the sub-frame relative to the machine frame.

9 Claims, 1 Drawing Sheet

TAMPING MACHINE

CROSS-REFERENCES TO RELATED APPLICATIONS

This application claims the priority of Austrian utility model application GM 507/2002, filed Jul. 29, 2002, the subject matter of which is incorporated herein by reference.

BACKGROUND OF THE INVENTION

The present invention relates, in general, to a tamping machine for tamping ballast underneath ties of a track.

U.S. Pat. No. 4,632,037 discloses a tamping machine having a machine frame extending in a longitudinal direction and supported on the track by two undercarriages for mobility in an operating direction. A sub-frame is arranged between the undercarriages and supported for mobility on the track by a further undercarriage having a unit motive drive. The sub-frame is connected to the machine frame by means of a frame support for displacement relative thereto in the longitudinal direction. A vertically adjustable tamping unit and track lifting unit are arranged on the sub-frame between the further undercarriage and the frame support. In a tamping machine of this type, there is no need to stop a major part of the overall mass of the tamping machine, each time a tie is to be tamped, and then to accelerate it again, as only the sub-frame, carrying the working units, is subjected to this stop-and-go procedure. The displacement of the sub-frame is effected, on the one hand, by a motive drive integrated in the undercarriage of the sub-frame, and, on the other hand, by means of a hydraulic cylinder connecting the machine frame and sub-frame to one another.

It would be desirable and advantageous to provide an improved tamping machine of the afore-described type, with which it is possible to achieve a better acceleration of the sub-frame.

SUMMARY OF THE INVENTION

According to one aspect of the present invention, a tamping machine for tamping ballast underneath ties of a track is provided which comprises a machine frame extending in a longitudinal direction and supported on the track by two undercarriages for mobility in an operating direction; and a sub-frame arranged between the said undercarriages and supported for mobility on the track by a further undercarriage comprising a unit motive drive, the sub-frame being connected to the machine frame by means of a frame support for displacement relative thereto in the longitudinal direction. A vertically adjustable tamping unit and a track lifting unit are arranged on the sub-frame between the further undercarriage and the frame support. An acceleration drive is provided for assisting the unit motive drive in displacing the sub-frame in the longitudinal direction, the acceleration drive being rigidly connected to the machine frame by means of a drive fastening and comprising a piston end including a bracing plunger provided for temporary application to the sub-frame, wherein a maximum stroke m of the acceleration drive is shorter than a maximum displacement path a of the sub-frame relative to the machine frame.

In a machine including an acceleration drive designed in this way, the latter has the effect of an impulse generator, used for providing optimum assistance of the acceleration and support of the starting motion of the sub-frame. After this initial acceleration phase, the further advance of the sub-frame is accomplished in an optimal manner exclusively by means of the motive drive which is integrated in the undercarriage of the sub-frame.

According to another aspect of the present invention, the acceleration drive provided for assisting the unit motive drive in displacing the sub-frame in the longitudinal direction is rigidly connected to the sub-frame by means of a drive fastening and comprises a piston end including a bracing plunger provided for temporary application to the machine frame, wherein a maximum stroke m of the acceleration drive is shorter than a maximum displacement path a of the sub-frame relative to the machine frame.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
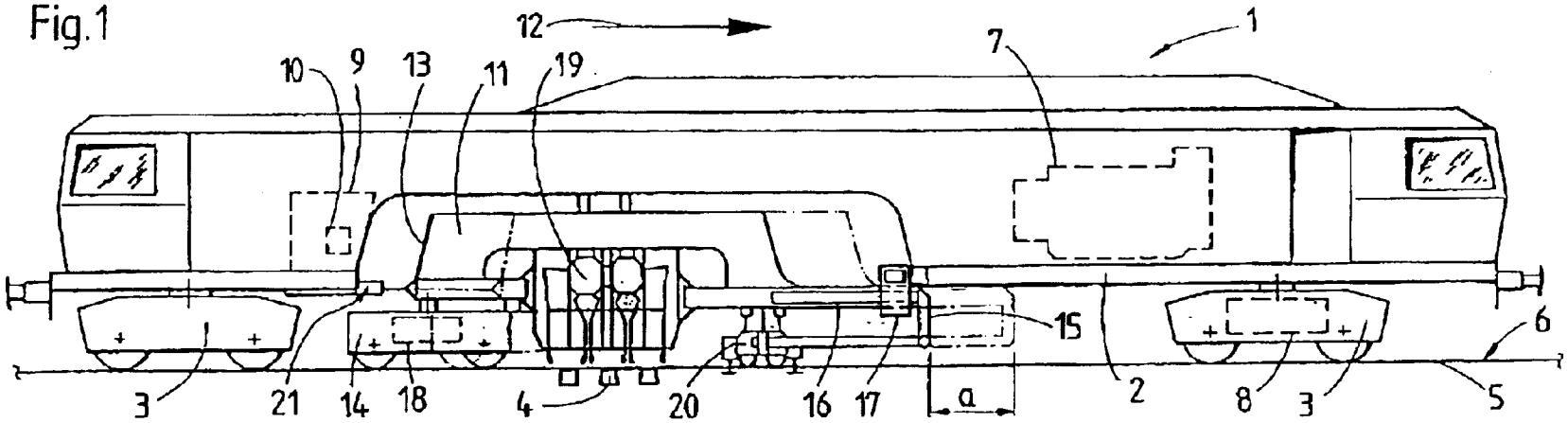
FIG. 1 is a schematic side elevational view of one embodiment of a tamping machine according to the present invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a tamping machine 1 which includes a machine frame 2 extending in a longitudinal direction and mobile by means of on-track undercarriages 3, arranged at each end respectively, on a track 6 composed of ties 4 and rails 5. For the purpose of mobility in an operating direction 12, the machine 1 is equipped with a motor 7 and a motive drive 8. A control device 10 is located in a work cabin 9.

A sub-frame 11 is arranged between the two on-track undercarriages 3 of the machine frame 2. At a rear end 13—with regard to the operating direction 12—of the sub-frame 11, the latter is equipped with a further undercarriage 14. At a front end 15 of the sub-frame 11, two frame beams 16 are provided which are arranged in opposite relationship to one another transversely of the longitudinal direction of the machine and are supported for displacement in the longitudinal direction by means of frame supports 17 mounted to the machine frame 2. The undercarriage 14 of the sub-frame 11 is equipped with its own primary unit motive drive 18. Immediately in front of the undercarriage 14, a tamping unit 19 designed for the simultaneous tamping of three ties 4 is provided on the sub-frame 11. A track lifting unit 20 precedes the tamping unit 19 in the operating direction 12, and both units 19 and 20 are connected for vertical adjustment to the sub-frame 11.

Figure 2:
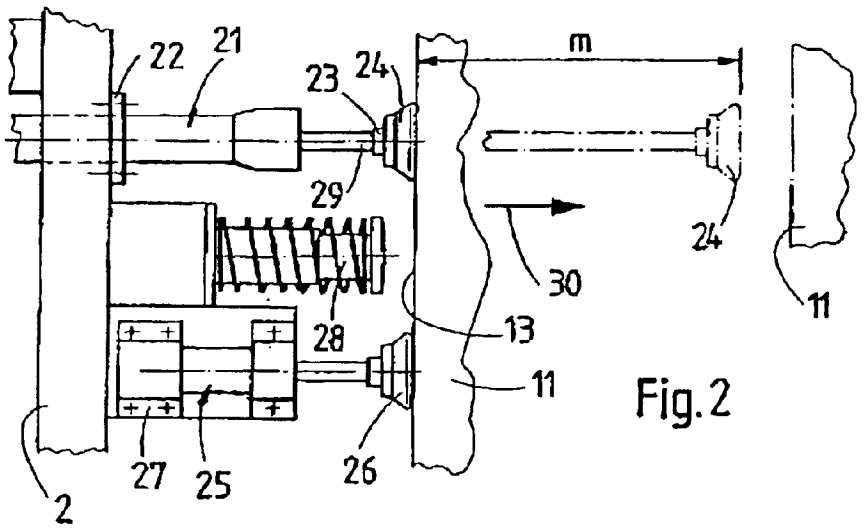
FIG. 2 is a detailed top view, on an enlarged scale, of a part of the tamping machine, showing in detail an arrangement of two secondary acceleration drives.

As is shown in FIGS. 1 and 2, a secondary acceleration drive 21 is provided between the rear end 13 of the sub-frame 11 and the machine frame 2. The acceleration drive 21 is designed as a hydraulic cylinder and is connected by means of a drive fastening 22 rigidly and exclusively to the machine frame 2. The hydraulic acceleration drive 21 has a free piston end 23 at which a bracing plunger 24 is provided, intended for temporary application to the sub-frame 11. A maximum stroke "m" of the acceleration drive 21 is preferably about 800 mm, which is shorter than a maximum displacement path "a" of the machine frame 2 relative to the sub-frame 11.

Additionally, a second acceleration drive 25 with a bracing plunger 26 is provided in order to further assist in the initial acceleration of the sub-frame 11, the acceleration drive 25 being connected to the machine frame 2 by means of a further drive fastening 27. A maximum stroke of said second acceleration drive 25 measures merely 120 mm. A spring buffer 28 is connected to the machine frame 2 between the two acceleration drives 21 and 25.

As the machine frame 2, during working operations, moves forward continuously in the operating direction 12, the motion of the sub-frame 11—relative to the machine frame 2—is composed of a quick forward acceleration and a subsequent local stoppage for carrying out a tamping operation under the ties 4. The forward acceleration takes place starting from a rearward end position (shown in FIGS. 1 and 2 in solid lines) and progressing to a forward end position (shown in dash-dotted lines). In order to assist the unit motive drive 18 during the initial acceleration phase, the two acceleration drives 21 and 25 are actuated. These drives, 21, 25 push the sub-frame 11 in the direction towards the forward end position (see arrow 30), after which the bracing plungers 24 and 26, after reaching the end of their respective maximum stroke, automatically become detached from the sub-frame 11 as the latter moves away. The sub-frame 11 is ultimately moved to the forward end position with the aid of the unit motive drive 18 (see dash-dotted line in FIG. 1).

As a result of the temporary local stoppage of the sub-frame 11 during the tamping operation, the bracing plunger 24 situated in the forward end position is gradually applied to the sub-frame 11 with the forward movement of the machine frame 2. In further sequence, an extended piston rod 29, connected to the bracing plunger 24 and being in a pressureless floating position, is thereby moved back into the initial position. Analogue thereto, the second bracing plunger 26 is also moved back into its initial position. As soon as the sub-frame 11 reaches its rearward end position, a new displacement cycle for the sub-frame 11 begins again with actuation of the two acceleration drives 21, 25 and the unit motive drive 18.

Figure 3:
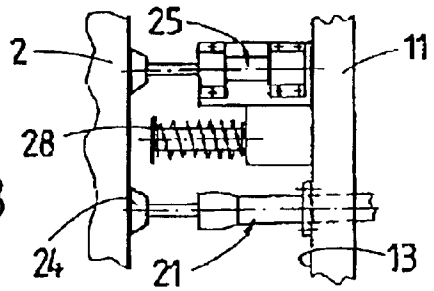
FIG. 3 is a schematic fragmentary top view of another embodiment of a tamping machine according to the present invention.

Turning now to FIG. 3, there is shown another embodiment of a tamping machine according to the present invention. Parts corresponding with those in FIG. 1 are denoted by identical reference numerals and not explained again. The description below will center on the differences between the embodiments. In this embodiment, the acceleration drives 21, 25 are fastened to the sub-frame 11, and the bracing plungers 24, in turn, bear on the machine frame 2.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A tamping machine for tamping ballast underneath ties of a track, comprising:

a) a machine frame extending in a longitudinal direction and supported on the track by two undercarriages for mobility in an operating direction;

b) a sub-frame arranged between the said undercarriages and supported for mobility on the track by a further undercarriage comprising a unit motive drive, the sub-frame being connected to the machine frame by means of a frame support for displacement relative thereto in the longitudinal direction;

c) a vertically adjustable tamping unit and track lifting unit arranged on the sub-frame between the further undercarriage and the frame support; and d) an acceleration drive provided for assisting the unit motive drive in displacing the sub-frame in the longitudinal direction, the acceleration drive being rigidly connected to the machine frame by means of a drive fastening and comprising a piston end including a bracing plunger provided for temporary application to the sub-frame, wherein a maximum stroke m of the acceleration drive is shorter than a maximum displacement path a of the sub-frame relative to the machine frame.

2. A tamping machine for tamping ballast underneath ties of a track, comprising:

a) a machine frame extending in a longitudinal direction and supported on the track by two undercarriages for mobility in an operating direction;

b) a sub-frame arranged between the said undercarriages and supported for mobility on the track by a further undercarriage comprising a unit motive drive, the sub-frame being connected to the machine frame by means of a frame support for displacement relative thereto in the longitudinal direction;

c) a vertically adjustable tamping unit and track lifting unit arranged on the sub-frame between the further undercarriage and the frame support; and d) an acceleration drive provided for assisting the unit motive drive in displacing the sub-frame in the longitudinal direction, the acceleration drive being rigidly connected to the sub-frame by means of a drive fastening and comprising a piston end including a bracing plunger provided for temporary application to the machine frame, wherein a maximum stroke m of the acceleration drive is shorter than a maximum displacement path a of the sub-frame relative to the machine frame.

3. A method of assisting a relative displacement between a machine frame (2), moving continuously in an operating direction (12), and a sub-frame (11) which is displaceable relative thereto in the operating direction (12) with the aid of an acceleration drive (21), wherein a displacement cycle is composed of an advancing motion of the sub-frame (11) in the operating direction (12) and a subsequent local stoppage of the sub-frame (11) while the machine frame (2) moves on continuously, comprising the following steps:

a) simultaneous actuation of a unit motive drive (18) of the sub-frame (11) and the acceleration drive (21) for effecting an advancing motion of a bracing plunger (24), butting against the sub-frame (11), together with the sub-frame (11) from an initial position to an end position;

b) detaching the bracing plunger (24) from the sub-frame (11) and moving the latter forward by means of the unit motive drive (18);

c) switching the acceleration drive (21) to a floating position;

d) running the bracing plunger (24), moved forward as a result of the continuous advance of the machine frame (2), up against the sub-frame (11) which is stopped locally for carrying out a track tamping operation; and e) automatic return of the bracing plunger (24) into the initial position due to the displacement of the machine frame (2) relative to the locally stopped sub-frame (11).

4. A tamping machine for tamping ballast underneath ties of a track, comprising;

a track-bound machine frame defining an axis and having two undercarriages for mobility in an operating direction;

a self-propelled sub-frame arranged between the undercarriages and having an undercarriage for support on the track, said sub-frame being connected to the machine frame for displacement relative thereto in the direction of the axis;

a vertically adjustable tamping unit and track lifting unit arranged on the sub-frame; and an acceleration drive constructed to assist the displacement of the sub-frame and including a piston having an end and a movable bracing plunger connected to the end of the piston for applying a propulsion force to move the sub-frame, wherein the acceleration drive has a maximum stroke which is shorter than a maximum displacement of the sub-frame relative to the machine frame.

5. The tamping machine of claim 4, wherein the acceleration drive is rigidly connected to the machine frame, and the bracing plunger acts on the sub-frame.

6. The tamping machine of claim 4, wherein the acceleration drive is rigidly connected to the sub-frame, and the bracing plunger acts on the machine frame.

7. A tamping method, comprising the steps of:

mounting a tamping unit to a sub-frame of a tamping machine to allow movement thereof relative to a machine frame of the tamping machine;

assisting an acceleration of the sub-frame by a primary drive through actuation of a secondary drive through application of a propulsion force by means of a bracing plunger so that the sub-frame is advanced from a trailing end position to a leading end position in relation to the machine frame, whereby the bracing plunger no longer applies the propulsion force upon the sub-frame in the leading end position;

stopping the sub-frame when reaching the leading end position for allowing the tamping unit to execute a tamping operation, while the tamping machine continues to advance; and switching the bracing plunger into a pressureless state to automatically return the sub-frame to the trailing end position, as the tamping machine continues to advance.

8. The tamping method of claim 7, wherein the bracing plunger bears upon the sub-frame of the tamping machine during the actuation step.

9. The tamping method of claim 7, wherein the bracing plunger bears upon the machine frame of the tamping machine during the actuation step.

* * * * *